United States Patent [19]

Tack et al.

[11] Patent Number: 4,810,260

[45] **Date of Patent: * Mar. 7, 1989**

[54] MIDDLE DISTILLATE COMPOSITIONS WITH IMPROVED COLD FLOW PROPERTIES

[75] Inventors: Robert D. Tack, Abingdon; Sarah L. Pearce, Wantage, both of United Kingdom; Albert Rossi, Warren, N.J.

[73] Assignee: Exxon Chemical Patents Inc., Linden, N.J.

[ * ] Notice: The portion of the term of this patent subsequent to Dec. 15, 2004 has been disclaimed.

[21] Appl. No.: 90,185

[22] Filed: Aug. 27, 1987

Related U.S. Application Data

[63] Continuation of Ser. No. 703,339, Feb. 20, 1985, Pat. No. 4,713,088.

[30] Foreign Application Priority Data

Feb. 21, 1984 [GB] United Kingdom ..... 8404518
Aug. 10, 1984 [GB] United Kingdom ..... 8420435

[51] Int. Cl.[4] ..... C10L 1/14
[52] U.S. Cl. ..... 44/62; 44/110
[58] Field of Search ..... 44/62, 70

[56] References Cited

U.S. PATENT DOCUMENTS

| | | | |
|---|---|---|---|
| 2,655,479 | 10/1953 | Munday et al. | 252/56 |
| 2,824,840 | 2/1958 | Cashman et al. | 252/56 |
| 3,048,479 | 8/1962 | Ilnyckyj et al. | 44/62 |
| 3,252,771 | 5/1966 | Clough et al. | 44/62 |
| 3,413,103 | 11/1968 | Young et al. | 44/62 |
| 3,726,653 | 4/1973 | van der Meij et al. | 44/62 |
| 3,961,916 | 6/1976 | Ilnyckyj et al. | 44/62 |
| 3,981,850 | 9/1976 | Wisotsky et al. | 44/62 |
| 4,087,255 | 5/1978 | Wisotsky et al. | 44/62 |
| 4,153,422 | 5/1979 | Wisotsky | 44/62 |
| 4,153,423 | 5/1979 | Wisotsky | 44/62 |
| 4,153,424 | 5/1979 | Wisotsky | 44/62 |
| 4,175,926 | 11/1979 | Wisotsky | 44/62 |
| 4,210,424 | 7/1980 | Feldman et al. | 44/62 |
| 4,211,534 | 7/1980 | Feldman | 44/62 |
| 4,261,703 | 4/1981 | Tack et al. | 44/62 |

FOREIGN PATENT DOCUMENTS

| | | |
|---|---|---|
| 0061895 | 10/1982 | European Pat. Off. . |
| 0061894A2 | 10/1982 | European Pat. Off. . |
| 1263152 | 2/1972 | United Kingdom . |
| 1469016 | 3/1977 | United Kingdom . |
| 2023645B | 10/1982 | United Kingdom . |

*Primary Examiner*—William R. Dixon, Jr.
*Assistant Examiner*—Margaret B. Medley
*Attorney, Agent, or Firm*—M. B. Kapustij

[57] ABSTRACT

The low temperature properties of a distillate petroleum fuel oil boiling in the range 120° C. to 500° C., and whose 20% and 90% distillation points differ by less than 100° C., and/or whose Final Boiling Point is in the range 340° C. to 370° C. are improved by the addition of a polymer or copolymer having at least 25 wt. % of n-alkyl groups of average number of carbon atoms from 12 to 14 with no more than 10 wt. % containing more than 14 carbon atoms.

6 Claims, No Drawings

MIDDLE DISTILLATE COMPOSITIONS WITH IMPROVED COLD FLOW PROPERTIES

This is a continuation of application Ser. No. 703,339, filed Feb. 20, 1985, now U.S. Pat. No. 4,713,088.

Mineral oils containing paraffin wax have the characteristic of becoming less fluid as the temperature of the oil decreases. This loss of fluidity is due to the crystallization of the wax into plate-like crystals which eventually form a spongy mass entrapping the oil therein.

It has long been known that various additives act as wax crystal modifiers when blended with waxy mineral oils. These compositions modify the size and shape of wax crystals and reduce the adhesive forces between the crystals and between the wax and the oil in such a manner as to permit the oil to remain fluid at a lower temperature.

Various pour point depressants have been described in the literature and several of these are in commercial use. For example, U.S. Pat. No. 3,048,479 teaches the use of copolymers of ethylene and $C_3$–$C_5$ vinyl esters, e.g. vinyl acetate, as pour depressants for fuels, specifically heating oils, diesel and jet fuels. Hydrocarbon polymeric pour depressants based on ethylene and higher alpha-olefins, e.g. propylene, are also known. U.S. Pat. No. 3,961,916 teaches the use of a mixture of copolymers, one of which is a wax crystal nucleator and the other a growth arrestor to control the size of the wax crystals.

United Kingdom Pat. No. 1263152 suggests that the size of the wax crystals may be controlled by using a copolymer having a lower degree of side chain branching.

It has also been proposed in for example United Kingdom Pat. No. 1469016 that the copolymers of di-n-alkyl fumarates and vinyl acetate which have previously been used as pour depressants for lubricating oils may be used as co-additives with ethylene/vinyl acetate copolymers in the treatement of distillate fuels with high final boiling points to improve their low temperature flow properties. According to United Kingdom Patent 1469016 these polymers may be $C_6$ to $C_{18}$ alkyl esters of unsaturated $C_4$ to $C_8$ dicarboxylic acids particularly lauryl fumarate and lauryl-hexadecyl fumarate. Typically the materials used are mixed esters with an average of about 12 carbon atoms (Polymer A). It is notable that the additives are shown not to be effective in the "conventional" fuels of lower Final Boiling Point (Fuels III and IV).

U.S. Pat. No. 3,252,771 relates to the use of polymers of $C_{16}$ to $C_{18}$ alpha-olefines obtained by polymerising olefin mixtures that predominate in normal $C_{16}$ to $C_{18}$ alpha-olefines with aluminium trichloride/alkyl halide catalysts as pour point and cloud point depressants in distillate fuels of the broad boiling, easy to treat types available in the United States in the early 1960's.

With the increasing diversity in distillate fuels, types of fuel have emerged which cannot be treated by the existing additives or which require an unecomonically high level of additive to achieve the necessary reduction in their pour point and control of wax crystal size for low temperature filterability to allow them to be used commercially. One particular group of fuels that present such problems are those which have a relatively narrow, and/or low boiling range. Fuels are frequently characterised by their Initial Boiling Point, Final Boiling Point and the interim temperatures at which certain volume percentages of the initial fuel have been distilled. Fuels whose 20% to 90% distillation point differ within the range of from 70° to 100° C. and/or whose 90% boiling temperature is from 10° to 25° C. of the final boiling point and/or whose final boiling points are between 340° and 370° C. have been found particularly difficult to treat sometimes being virtually unaffected by additives or otherwise requiring very high levels of additive. All distillations referred to herein are according to ASTM D86.

With the increase in the cost of crude oil, it has also become important for a refiner to increase his production of distillate fuels and to optimise his operations using what is known as sharp fractionation again resulting in distillate fuels that are difficult to treat with conventional additives or that require a treat level that is unacceptably high from the economic standpoint. Typical sharply fractionated fuels have a 90% to final boiling point range of 10° to 25° C. usually with a 20 to 90% boiling range of less than 100° C., generally 50° to 100° C. Both types of fuel have final boiling points above 340° C. generally a final boiling point in the range 340° C. to 370° C. especially 340° C. to 365° C.

The copolymers of ethylene and vinyl acetate which have found widespread use of improving the flow of the previously widely available distillate fuels have not been found to be effective in the treatment of the narrow boiling and/or sharply fractionated fuels described above. Furthermore use of mixtures as illustrated in United Kingdom Pat. No. 1469016 have not been found effective.

We have found however that polymers and copolymers containing very specific alkyl groups, such as specific di-n-alkyl fumarate/vinyl acetate copolymers, are effective in both lowering the pour point of the difficult to treat fuels described above and controlling the size of the wax crystals to allow filterability including those fuels of the lower final boiling point in which the additives of United Kingdom Pat. No. 1469016 were ineffective.

Specifically we have found that the average number of carbon atoms in the alkyl groups in the polymer or copolymer must be from 12 to 14 and that no more than 10 wt. % of the alkyl groups should contain more than 14 carbon atoms and preferably no more than 20 wt. % of the alkyl groups contain fewer than 12 carbon atoms. These polymers are particularly effective when used in combination with other low temperature flow improvers which on their own are ineffective in these types of fuels.

The present invention therefore provides the use for improving the flow properties of a distillate petroleum fuel oil boiling in the range 120° C. to 500° C., whose 20% and 90% distillation points differ by less than 100° C., and/or for improving the flow properties of a distillate fuel whose 90% to final boiling point range is 10° to 25° C. and/or whose Final Boiling Point is in the range 340° C. to 370° C. of an additive comprising a polymer containing at least 25 wt. % of n-alkyl groups, the average number of carbon atoms in the n-alkyl groups is from 12 to 14 and no more than 10 wt. % of the alkyl groups contain more than 14 carbon atoms and preferably no more than 20 wt. % of the alkyl groups contain fewer than 12 carbon atoms.

The additives are preferably used in an amount from 0.0001 to 0.5 wt. %, preferably 0.001 and 0.2 wt. % based on the weight of the distillate petroleum fuel oil, and the present invention also includes such treated distillate fuel.

The preferred polymer is a copolymer containing at least 25 preferably at least 50 wt. % more preferably from 75 to 90 wt. % of a di-n alkyl ester of a dicarboxylic acid containing alkyl groups containing an average of 12 to 14 carbon atoms and 10 to 50 wt. % of another unsaturated ester such as a vinyl ester and/or an alkyl acrylate, methacrylate or alpha olefine. Equimolar copolymers of a di-n-alkyl fumarate and vinyl acetate are particularly preferred.

The polymers or copolymers used in the present invention preferably have a number average molecular weight in the range of 1000 to 100,000, preferably 1,000 to 30,000 as measured, for example, by Vapor Pressure Osmometry.

The carboxylic acid esters useful for preparing the preferred polymer can be represented by the general formula:

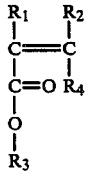

where in $R_1$ and $R_2$ are hydrogen or a $C_1$ to $C_4$ alkyl group, e.g., methyl, $R_3$ is the $C_{12}$ to $C_{14}$ average, straight chain alkyl group, and $R_4$ is $COOR_3$, hydrogen or a $C_1$ to $C_4$ alkyl group, preferably $COOR_3$. These may be prepared by esterifying the particular mono- or di-carboxylic acid with the appropriate alcohol or mixture of alcohols.

Other unsaturated esters, which can be copolymerized are the $C_{12}$–$C_{14}$ alkyl acrylates and methacrylates.

The dicarboxylic acid mono- or di-ester monomers may be copolymerized with various amounts, e.g., 5 to 70 mole %, of other unsaturates esters or olefins. Such other esters include short chain alkyl esters having the formula:

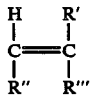

where R′ is hydrogen or a $C_1$ to $C_4$ alkyl group, R″ is —COOR″″ or —OOCR″″ where R″″ is a $C_1$ to $C_5$ alkyl group branched or unbranched, and R‴ is R″ or hydrogen. Examples of these short chain esters are methacrylates, acrylates, the vinyl esters such as vinyl acetate and vinyl propionate being preferred. More specific examples include methyl methacrylate, isopropenyl acetate and butyl and isobutyl acrylate.

Our preferred copolymers contain from 40 to 60 mole % of a $C_{12}$–$C_{14}$ average dialkyl fumarate and 60 to 40 mole % of vinyl acetate.

Where ester polymers or copolymers are used they may conveniently be prepared by polymerising the ester monomers in a solution of a hydrocarbon solvent such as heptane, benzene, cyclohexane, or white oil, at a temperature generally in the range of from 20° C. to 150° C. and usually promoted with a peroxide or axo type catalyst, such as benzoyl peroxide or azodiisobutyronitrile, under a blanket of an inert gas such as nitrogen or carbon dioxide, in order to exclude oxygen.

The additives of the present invention are particularly effective when used in combination with other additives known for improving the cold flow properties of distillate fuels generally, although they may be used on their own to impart a combination of improvements to the cold flow behaviour of the fuel.

The additives of the present invention are particularly effective when used with the polyoxyalkylene esters, ethers, ester/ethers and mixtures thereof, particularly those containing at least one, preferably at least two $C_{10}$ to $C_{30}$ linear saturated alkyl groups and a polyoxyalkylene glycol group of molecular weight 100 to 5,000 preferably 200 to 5,000, the alkyl group in said polyoxyalkylene glycol containing from 1 to 4 carbon atoms. These materials form the subject of European Patent Publication No. 0061895A2.

The preferred esters, ethers or ester/ethers useful in the present invention may be structurally depicted by the formula:

$$R—O—(A)—O—R^1$$

where R and $R^1$ are the same or different and may be

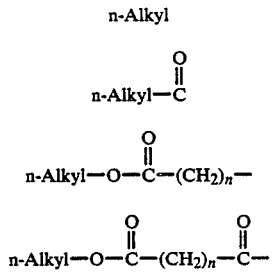

(i) n-Alkyl (ii) n-Alkyl—C(=O)—

(iii) n-Alkyl—O—C(=O)—$(CH_2)_n$—

(iv) n-Alkyl—O—C(=O)—$(CH_2)_n$—C(=O)— the alkyl group being linear and saturated and containing 10 to 30 carbon atoms, and A represents the polyoxyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be tolereated but it is preferred the glycol should be substantially linear.

Suitable glycols generally are the substantially linear polyethylene glycols (PEG) and polypropylene glycols (PPG) having a molecular weight of about 100 to 5,000 preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols.

Polyoxyalkylene diesters, diethers, ether/esters and mixtures thereof are suitable as additives with diesters preferred for use in narrow boiling distillates. While minor amounts of monoethers and monoesters may also be present and are often formed in the manufacturing process. It is important for additive performance that a major amount of the dialkyl compound is present. In particular stearic or behenic diesters of polyethylene glycol, polypropylene glycol or polyethylene/polypropylene glycol mixtures are preferred.

The additive of this invention may also be used with the ethylene unsaturated ester copolymer flow improvers. The unsaturated monomers which may be copolymerized with ethylene include unsaturated mono and diesters of the general formula:

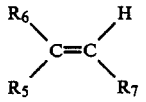

wherein $R_6$ is hydrogen or methyl; $R_5$ is a —$OOCR_8$ group wherein $R_8$ is hydrogen or a $C_1$ to $C_{28}$, more usually $C_1$ to $C_{17}$, and preferably a $C_1$ to $C_8$, straight or branched chaing alkyl group; or $R_5$ is a —$COOR_8$ group wherein $R_8$ is as previously described but is not hydrogen and $R_7$ is hydrogen or —$COOR_8$ as previously defined. The monomer, when $R_5$ and $R_7$ are hydrogen and $R_6$ is —$OOCR_8$, includes vinyl alcohol esters of $C_1$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. We prefer that the copolymers contain from 20 to 40 wt. %. of the vinyl ester more preferably from 25 to 35 wt. % vinyl ester. They may also be mixtures of two copolymers such as those described in U.S. Pat. No. 3,961,916.

It is preferred that these copolymers have a number average molecular weight as measured by vapor phase osmometry of 1000 to 6000, preferably 1000 to 3000.

The additives of the present invention may also be used in distillate fuels in combination with polar compounds, either ionic or nonionic, which have the capability in fuels of acting as wax crystal growth inhibitors. Polar nitrogen containing compounds have been found to be especially effective when used in combination with the glycol esters, ethers or ester/ethers and such three component mixtures are within the scope of the present invention. These polar compounds are generally aimine salts and/or amides formed by reaction of at least one molar proportion of hydrocarbyl substituted amines with a molar proportion of hydrocarbyl acid having 1 to 4 carboxylic acid groups or their anhydrides; ester/amides may also be used contain 30 to 300 preferably 50 to 150 total carbon atoms. These nitrogen compounds are described in U.S. Pat. No. 4,211,534. Suitable amines are usually long chain $C_{12}$–$C_{40}$ primary, secondary, tertiary or quarternary amines or mixtures thereof but shorter chain amines may be ued provided the resulting nitrogen compound is oil soluble and therefore normally containing about 30 to 300 total carbon atoms. The nitrogen compound preferably contains at least one straight chain $C_8$–$C_{40}$ preferably $C_{14}$ to $C_{24}$ alkyl segment.

Suitable amines include primary, secondary, tertiary or quaternary, but preferably are secondary. Tertiary and quarternary amines can only form amine salts. Examples of amines include tetradecyl amine, cocoamine, hydrogenated tallow amine and the like. Examples of secondary amines include dioctadecyl amine, methylbehenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclo-hexane 1,2 dicarboxylic acid, cyclohexene dicarboxylic acid, cyclopentane, 1,2 dicarboxylic acid, naphthalene dicarboxylic acid and the like. Generally these acids will have about 5–13 carbon atoms in the cyclic moiety. Preferred acids useful in the present invention are benzene dicarboxylic acids such as ortho-phthalic acid, para-phthalic acid, and meta-phthalic acid. Ortho-phthalic acid or its anhydride is particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

The relative proportions of additives used in the mixtures are from 0.5 to 20 parts by weight of the polymer of the invention containing the n-alkyl groups containing an average of 12 to 14 carbom atoms to 1 part of the other additives such as the polyoxyalkylene esters, ether or ester/ether, more preferably from 1.5 to 9 parts by weight of the polymer of the invention.

The additive systems of the present invention may conveniently be supplied as concentrates for incorporation into the bulk distillate fuel. These concentrates may also contain other additives as required. These concentrates preferably contain from 3 to 75 wt. %, more preferably 3 to 60 wt. %, most preferably 10 to 50 wt. % of the additives preferably in solution in oil. Such concentrates are also within the scope of the present invention.

The present invention is illustrated by the following Examples in which the effectiveness of the additives of the present invention as pour point depressants and filterability improvers were compared with other similar additives in the following tests.

By one method, the response of the oil to the additives was measured by the Cold Filter Plugging Point Test (CFPP) which is carried out by the procedure described in detail in "Journal of the Institute of Petroleum", Volume 52, Number 510, June 1966, pp. 173–185. This test is designed to correlate with the cold flow of a middle distillate in automative diesels.

In brief, a 40 ml sample of the oil to be tested is cooled in a bath which is maintained at about —34° C. to give non-linear cooling at about 1° C./min. Periodically (at each one degree Centrigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml of oil. After each successful passage the oil is returned immediately to the CFPP tube. The test is repeated with each one degree drop in temperature unitl the oil fails to fill the pipette within 60 seconds. This temperature is reported as the CFPP temperature. The difference between the CFPP of an additive free fuel and of the same fuel containing additive is reported as the CFPP depression by the additive. A more effective flow improver gives a greater CFPP depression at the same concentration of additive.

Another determination of flow improver effectiveness is made under conditions of the flow improver distillate operability test (DOT test) which is a slow cooling test designed to correlate with the pumping of a stored heating oil. In this test the cold flow properties of the described fuels containing the additives were determined by the DOT test as follows. 300 ml of fuel are cooled linearly at 1° C./hour to the test temperature and the temperature then held constant. After 2 hours at the test temperature, approximately 20 ml of the surface layer is removed as the abnormally large wax crystals which tend to form on the oil/air interface during cooling. Wax which has settled in the bottle is dispersed by gentle stirring, then a CFPP filter assembly is inserted. The tap is opened to apply a vacuum of 500 mm of mercury, and closed when 200 ml of fuel have passed through 1 the filter into the graduated receiver. A PASS is recorded if the 200 ml are collected within ten seconds through a given mesh size or a FAIL if the flow rate is too slow indicating that the filter has become blocked.

CFPP filter assemblies with filter screens of 20, 30, 40, 60, 80, 100, 120, 150, 200, 250 and 350 mesh numbers are used to determine the finest mesh (largest mesh number) the fuel will pass. The large the mesh number that a wax containing fuel will pass, the smaller are the wax crystals and the greater the effectiveness of the additive flow improver. It should be noted that no two fuels will give exactly the same test results at the same treatment level for the same flow improver additive.

The Pour Point was determined by two methods, either the ASTM D 97 or a visual method in which 100 ml samples of fuel in a 150 ml narrow necked bottle containing the additive under test, are cooled at 1° C./hour from 5° C. above the wax appearance temperature. The fuel samples were examined at 3° C. intervals for their ability to pour when tilted or inverted. A fluid sample (designated F) would move readily on tilting, a semi-fluid (designated semi-F) sample may need to be almost inverted, while a solid sample (designated S) can be inverted with no movement of the sample.

The fuels used in these Examples were:

| Fuel | Wax Appearance Point | ASTM-D-86 Distillation, °C. Initial Boiling Point | 20% | 90% | Final Boiling Point |
|---|---|---|---|---|---|
| A | −5 | 202 | 270 | 328 | 343 |
| B | −2 | 202 | 254 | 340 | 365 |
| C | −2.5 | 274 | 286 | 330 | 348 |
| D | −4 | 155 | 215 | 335 | 358 |
| E | −1.5 | 196 | 236 | 344 | 365 |

The Additives used were as follows:

Additive 1: A polyethylene glycol of 400 average molecular weight esterified with 2 moles of behenic acid.

Additive 2: A copolymer of a mixed $C_{12}/C_{14}$ alkyl fumarate obtained by reaction of 50:50 weight mixture of normal $C_{12}$ and $C_{14}$ alcohols with fumaric acid and vinyl acetate prepared by solution copolymerisation of a 1 to 1 mole ratio mixture at 60° C. using azo diisobutyronitrile as catalyst.

The results in the CFPP and Pour Point tests were as follows:

| Fuel | Additive | Amount ppm | CFPP | CFPP Depression | ASTM D 97 Pour Point |
|---|---|---|---|---|---|
| A | None | | −5° C. | | −9° C. |
| | 1 | 500 | −8° C. | 3° C. | −6° C. |
| | 2 | 500 | −3° C. | −2° C. | −15° C. |
| | 2:1 | 300:200 | −9° C. | 4° C. | −18° C. |
| | 2:1 | 600:400 | −11° C. | 6° C. | −18° C. |
| B | None | | −4° C. | | −6° C. |
| | 1 | 120 | | | −6° C. |
| | 1 | 300 | −8° C. | 4° C. | |
| | 2 | 180 | | | −15° C. |
| | 2 | 300 | −2° C. | −2° C. | |
| | 2:1 | 180/120 | −11° C. | 7 | −18° C. |
| | 2:1 | 300/200 | −13° C. | 9 | −21° C. |
| C | None | | −4° C. | | −6° C. |
| | 1 | 500 | −8° C. | 4 | −3° C. |
| | 1 | 1000 | −7° C. | 3 | |
| | 2 | 1000 | −2° C. | −2 | |
| | 2:1 | 300/200 | −6° C. | 2 | −12° C. |
| | 2:1 | 600/400 | −10° C. | 6 | −15° C. |

The additives of the invention were compared in the DOT test with Additive 3 which was an oil solution containing 63 wt. % of a combination of polymers comprising 13 parts by weight of an ethylene/vinyl acetate copolymer of number average molecular weight 2500 and vinyl acetate content of 36 wt. % and 1 part by weight of a copolymer of ethylene and vinyl acetate of number average molecular weight 3500 and a vinyl acetate content of about 13 wt. %.

| Fuel | DOT Test ppm of additive to pass DOT (120 mesh) at −10° C. Additive 3 | Mixture of 3 Parts of 1 and 2 Parts of 2 |
|---|---|---|
| A | >3,000 | 700 |
| B | 800 | 250 |
| C | 1,500 | 700 |
| D | 1,250 | 500 |
| E | >1,500 | 300 |

Various fumarate/vinyl acetate copolymers were tested in admixture (3 parts) with Additive 1 (2 parts) to determine the effect of the chain length in the fumarate with the following results.

| Fuel | Alcohols used to make fumarate | Average C Number in fumarate | Pour Point Test Appearance at −10° C. | CFPP Depression 500 ppm (ai) | 1,000 ppm (ai) |
|---|---|---|---|---|---|
| A | C-8 | 8 | S | 2 | 3 |
| | C-9 | 9 | — | 2 | — |
| | C-10 | 10 | S | 3 | 3 |
| | C-10/C-12 | 11 | S | 3 | 4 |
| | C-11 | 11 | — | 3 | 3 |
| | C-12 | 12 | S | 3 | 4 |
| | C-12,/C-14 | 13 | F | 5 | 7 |
| | C-14 | 14 | F | −2 | −2 |
| | | | | 300 ppm | |
| B | C-8 | 8 | S | 3 | |
| | C-9 | 9 | — | 5 | |
| | C-10 | 10 | S | 4 | |
| | C-10/C-12 | 11 | S | 5 | |
| | C-11 | 11 | — | 5 | |
| | C-12 | 12 | S | 3 | |
| | C-12/C-14 | 13 | F | 7 | |
| | C-14 | 14 | F | 0 | |
| | | | | 1,000 | |

-continued

| Fuel | Alcohols used to make fumarate | Average C Number in fumarate | Pour Point Test Appearance at −10° C. | CFPP Depression |
|---|---|---|---|---|
| | | | | ppm |
| C | C-10 | 10 | | 3 |
| | C-10/C-12 | 11 | | 3 |
| | C-11 | 11 | | 3 |
| | C-12 | 12 | | 3 |
| | C-12/C-14 | 13 | | 6 |
| | C-14 | 14 | | 0 |
| | C-18 | 18 | | 3 |

Various fumarate/vinyl acetate copolymers obtained from different alcohols but averaging 12 to 13.5 carbon atoms in the alkyl groups were tested in the same mixture as in the previous example in the CFPP and Visual pour point tests with the following results.

| Fumarate Alcohols (All n-alcohols except oxo-C-13) Ratio's hv weight | Alcohol Average C-number | Fuel A CFPP Depression 500 ppm | Fuel A CFPP Depression 1000 ppm | Fuel A Pour Point Appearance at −10° C. | Fuel B CFPP Depression 300 ppm | Fuel B CFPP Depression 500 ppm | Fuel B Pour Point Appearance at −10° C. | Fuel C CFPP Depression 1000 ppm | Fuel C Pour Point Appearance at −10° C. |
|---|---|---|---|---|---|---|---|---|---|
| 1. C-12/C-14 = 1/1 | 13.0 | 5 | 7 | F | 7 | 9 | F | 6 | F |
| 2. C-12/C-14 = 3/1 | 12.5 | 2 | 4 | Semi-F | 6 | 6 | Semi-F | 3 | — |
| 3. C-12/C-14 = 1/3 | 13.5 | 0 | 1 | F | 2 | 5 | F | 0 | — |
| 4. C-10/C-16 = 1/1 | 13.0 | −2 | −1 | F | 2 | 1 | F | 1 | — |
| 5. C-13 oxo (from tetrapropylene) | 13.0 | 3 | — | S | 5 | 5 | S | 3 | — |
| 6. C-12/C-14/C-16 = 2/1/1 | 13.5 | 1 | — | — | 1 | — | — | 0 | — |
| 7. C-12/C-14/c-16 = 8/3/1 | 12.7 | 4 | 7 | F | 7 | 9 | F | 7 | F |
| 8. C-8/C-10/C-12/C-14/C-16/C-18 = 9/11/36/30/10/4 | 12.2 | 4 | 6 | F | 4 | 7 | F | 2 | F |
| 9. C-8/C-10/C-12/C-14/C-16/C-18 = 3/8/33/37/12/8 | 13.0 | 0 | 1 | — | 2 | 2 | — | 1 | — |
| 10. C-12/C-14/C-16/C-18 = 45/38/12/5 | 13.4 | 0 | 0 | — | 2 | 2 | — | 1 | — |
| 11. C-8 to C-18 = 13/10/41/15/9/13 | 12.5 | 2 | 3 | — | 4 | 6 | — | 1 | — |

The fuels B and C were used in the following Examples together with

| Fuel F ASTM D-86 Distillation °C. IBP | 20% | 50% | 90% | FBP |
|---|---|---|---|---|
| 182 | 254 | 285 | 324 | 343 |

The results are CFPP and visual Pour Point results shown for various additives in the following table. Where the additive has no pour depressing effect the CFPP value is not measured because without pour depression the fuel cannot be used.

| Fuel B CFPP Depression | | | |
|---|---|---|---|
| Additive | 400 ppm | Fumarate vinyl acetate | 400 ppm fumarate/vinyl acetate |
| Alcohol content of Fumarate | 100 ppm | Additive 1 | 100 ppm Additive 1<br>100 ppm Additive 3 |
| $C_4$ | No pour depression* | | 2 |
| $C_6$ | | | 2 |
| $C_8$ | | | 2 |
| $C_9$ | | | 2 |
| $C_{10}$ | | | 2 |
| $C_{11}$ | | | 2 |
| $C_{12}$ | | | 2 |
| $C_{13}$ | | 7° C. | 8 |
| $C_{14}$ | | 0 | 2 |
| $C_{16}$ | No pour depression* | Raised by 2° C. | Raised by 2° C. |
| $C_{18}$ | | | |
| $C_{22}$ | | | |
| Mixed $C_{12}/C_{14}$ | | | |
| 3:1 | | No effect | 2 |
| 1:1 | | 8° C. | 9 |
| 1:3 | | 4° C. | 5 |
| $C_{18}/C_{16}$ 1:1 | | Raised by 1° C. | Raised by 1° C. |
| $C_{10}/C_{12}$ | | No effect | 2 |

*No pour depression observed at −10° C. after the 1° C./hour cool.

| CFPP Depression | | | |
|---|---|---|---|
| | Fuel C | Fuel F | |
| Additive | 800 pmm F/VA 200 pmm Additive 1 | 800 ppm F/VA 200 ppm Additive 1 | 800 ppm F/V 200 ppm 1 100 ppm 3 |
| Alcohol content of Fumarate | | | |
| $C_4$ | No pour depression* | | |
| $C_6$ | | | |
| $C_8$ | | | |
| $C_9$ | | | |
| $C_{10}$ | | | |
| $C_{11}$ | | | |
| $C_{12}$ | | | |
| $C_{13}$ | 3 | 9 | 4 |
| $C_{14}$ | 0 | 1 | 1 |
| $C_{16}$ | 0 | 2 | 1 |
| $C_{18}$ | No pour depression* | | — |
| $C_{22}$ | | | — |

-continued

| CFPP Depression | | | |
|---|---|---|---|
| Mixed $C_{12}/C_{14}$ | | | |
| 3:1 | No pour depression* | | 1 |
| 1:1 | 4 | 10 | 8 |
| 1:3 | 1 | 4 | 4 |
| $C_{18}/C_{16}$ 1:1 | 0 | 0 | 1 |
| $C_{10}/C_{12}$ 1:1 | No pour depression* | | 2 |

*No pour depression observed at −10° C. after the 1 hour cool

The Additives were also tested in combination with Additive 4 the half amide formed by reacting two moles of hydrogenated tallow amine with phthalic anhydride and the CFPP depressions in Fuel B were as follows

| Additive | CFPP Depressions |
|---|---|
| Additive 4 (250 ppm)<br>Additive 3 (100 ppm)<br>$C_{12}/C_{14}$ F/VA (250 ppm) | 6 |
| Additive 4 (300 ppm)<br>Additive 1 (100 ppm)<br>$C_{12E}/C_{14}$ F/VA (100 ppm) | 6 |
| Additive 4 (250 ppm)<br>$C_{12}/C_{14}$ F/VA (250 ppm) | 0 |

We claim:

1. An additive concentrate for use in distillate petroleum fuel oil boiling in the range of 120° C. to 500° C. in order to improve the cold flow properties of the fuel comprising an oil solution containing 3 to 75 wt. % of a copolymer consisting essentially of polyvinylester containing at least 25 wt. % of repeating monomer units of mono-ethylenically unsaturated $C_4$ to $C_8$ mono- or dicarboxylic acids esterified with at least two different n-alkyl groups wherein (1) said n-alkyl groups have an average number of carbon atoms of from 12 to 14; (2) no more than 10 wt. % of said esterified monomer units contain n-alkyl groups having mor than 14 carbon atoms; and (3) no more than 20 wt. % of said esterified monomer units contain n-alkyl groups having fewer than 12 carbon atoms.

2. The additive concentrate of claim 1 wherein said polyvinylester contains from about 10 to 50 wt. % of comonomer selected from the group consisting of alkyl acrylate, methacrylate and mixtures thereof.

3. The additive concentrate of claim 2 wherein said repeating esterified monomer units of the polyvinylester comprise dialkyl fumarate monomer units.

4. The additive said polyvinylester concentrate of claim 3 wherein contains from 60 to 40 mole % of vinyl acetate monomer units and 40 to 60 mole % dialkyl fumarate monomer units.

5. The additive concentrate of claim 4 wherein all the n-alkyl groups of said dialkyl fumarate comonomer units contain from 12 to 14 carbon atoms.

6. The additive concentrate of claim 5 wherein the n-alkyl groups of said dialkyl fumarate monomer units are about a 50/50 molar mixture of $C_{12}$ and $C_{14}$ alkyl groups.

* * * * *